US007680428B2

(12) United States Patent
Sakato et al.

(10) Patent No.: US 7,680,428 B2
(45) Date of Patent: Mar. 16, 2010

(54) GRID WIRE CLEANING MECHANISM

(75) Inventors: Shingo Sakato, Osaka (JP); Eiji Nimura, Osaka (JP); Hirohisa Endou, Osaka (JP); Toyotsune Inoue, Osaka (JP)

(73) Assignee: Kyocera Mita Corporation (JP)

( * ) Notice: Subject to any disclaimer, the term of this patent is extended or adjusted under 35 U.S.C. 154(b) by 429 days.

(21) Appl. No.: 11/829,689

(22) Filed: Jul. 27, 2007

(65) Prior Publication Data

US 2008/0069577 A1 Mar. 20, 2008

(30) Foreign Application Priority Data

Jul. 28, 2006 (JP) ..... 2006-205918

(51) Int. Cl.
*G03G 15/02* (2006.01)

(52) U.S. Cl. ..... 399/100; 399/44; 399/97

(58) Field of Classification Search ..... 399/44, 399/71, 97, 100, 311
See application file for complete search history.

(56) References Cited

U.S. PATENT DOCUMENTS 6,205,303 B1 * 3/2001 Fujii et al. ..... 399/100

FOREIGN PATENT DOCUMENTS

JP 10-207191 8/1998

* cited by examiner

*Primary Examiner*—David M Gray
*Assistant Examiner*—Barnabas T Fekete
(74) *Attorney, Agent, or Firm*—Ostrolenk Faber LLP

(57) ABSTRACT

A grid wire cleaning mechanism is provided to prevent a reduction in image quality due to the surface of the electrostatic latent image carrier not being uniformly charged as a result of corona products adhering unevenly to the surface of the grid wires to extend the life of the grid wires and grid wire contact member. A first abrading member 71 abrades grid wires 224. A movement device 73 moves the first abrading member 71 in the same direction as the direction of extension of the grid wires 224. A humidity measurement unit 741 measures the humidity near the grid wires 224. The operation control unit 743 operates the movement device 73 when cleaning the grid wires 224, but does not operate the movement device 73 when the humidity measured by the humidity measurement unit 741 exceeds a predetermined threshold value.

13 Claims, 5 Drawing Sheets

GRID WIRE CLEANING MECHANISM

CROSS-REFERENCE TO RELATED APPLICATIONS

This application claims priority to Japanese Patent Application No. 2006-205918 filed on Jul. 28, 2007. The entire disclosure of Japanese Patent Application No. 2006-205918 is hereby incorporated herein by reference.

BACKGROUND OF THE INVENTION

1. Field of the Invention

The present invention generally relates to a grid wire cleaning mechanism. More specifically, the present invention relates to a grid wire cleaning mechanism having a cleaning mechanism that cleans grid wires used in a charging device that charges the surface of an electrostatic latent image carrier of an image forming apparatus.

2. Background Information

An image forming apparatus includes an electrostatic latent image carrier, a developing device that supplies developer to the electrostatic latent image carrier, a charging device that charges the surface of the electrostatic latent image carrier, and an irradiation device that irradiates the surface of the electrostatic latent image carrier with laser light. In this image forming apparatus, first the surface of the electrostatic latent image carrier is charged by the charging device. The surface of the charged electrostatic latent image carrier is irradiated with laser light by the irradiation device based on image data, to form an electrostatic latent image on the electrostatic latent image carrier. Then, developer is supplied from the developing device to the electrostatic latent image carrier on which the electrostatic latent image is formed. In this way, a toner image is formed on the electrostatic latent image carrier.

Charging devices that charge the surface of electrostatic latent image carriers include scorotron charging devices. Scorotron charging devices include discharge wires, and grid wires disposed in opposition to the discharge wires and disposed along the electrostatic latent image carrier. A bias voltage is applied to the grid wires in this charging device. Thereafter the surface potential of the electrostatic latent image carrier is controlled to be constant by the grid wires. Corona products, specifically NOx, SOx, can adhere to the grid wires.

Some image forming apparatus include a wire cleaning mechanism to clean corona products adhering to the grid wires like that shown in Japanese Patent Application Laid-open No. H10-207191. This wire cleaning mechanism includes a discharge wire abrading member that can abrade the discharge wires, a grid wire abrading member that can abrade the grid wires, and a movement mechanism that moves the discharge wire abrading member and the grid wire abrading member in the direction that the wires are stretched. After, for example, a predetermined number of sheets has been printed, the discharge wire abrading member and the grid wire abrading member are moved in the direction that the wires are stretched by the movement mechanism, and the grid wire cleaning mechanism cleans both sets of wires.

In the grid wire cleaning mechanism in Japanese Patent Application Laid-open No. H10-207191, the wire cleaning operation is carried out after completion of printing a predetermined number of sheets, regardless of environment. If the humidity around the image forming apparatus is high, or specifically if the humidity near the grid wires is high, corona products (for example, NOx, SOx, and so on) are absorbed by moisture in the air, and liquefy on the surface of the grid wires. In other words, they become water droplets. The corona products have electrically insulating properties, but in the liquid state they are electrically conducting. Therefore, even if liquid corona products adhere to the surface of the grid wires, the electrical resistance of the grid wires does not increase.

If the grid wire cleaning device carries out the cleaning operation with liquid corona products adhering to the surface of the grid wires in this way, the liquid is spread over the surface of the grid wires as a whole. If the humidity drops, in other words if drying occurs, while the liquid is spread over the whole surface of the grid wires in this way, the corona products dissolved in the liquid solidify, so solid corona products adhere to the whole surface of the grid wires in an uneven manner. Here, the solid corona products have electrically insulating properties, so the electrical resistance of the parts of the grid wires where corona products adhere increases. This causes unevenness of charging the surface of the electrostatic latent image carrier, which causes faulty developing, such as uneven density in the images. In this case also the life of the grid wires is shortened. Corona products also adhere to the grid wire contact member, so the life of the grid wire contact member is also shortened.

In view of the above, it will be apparent to those skilled in the art from this disclosure that there exists a need for an improved grid wire cleaning mechanism. This invention addresses this need in the art as well as other needs, which will become apparent to those skilled in the art from this disclosure.

SUMMARY OF THE INVENTION

It is an object of the present invention to prevent a reduction in image quality due to the surface of the electrostatic latent image carrier not being uniformly charged as a result of corona products adhering unevenly to the surface of the grid wires by preventing the corona products from being spread by the grid wire contact member, and to prevent shortening of the life of the grid wires and grid wire contact member.

A grid wire cleaning mechanism according to a first aspect of the present invention cleans the grid wire of a charging device that charges the surface of an electrostatic latent image carrier of an image forming apparatus. The grid wire cleaning mechanism has a first abrading member, a movement device, a humidity measurement device, and an operation control device. The first abrading member is configured to abrade the grid wire. The movement device moves the first abrading member along a direction that is the same as the direction in which the grid wire is stretched. The humidity measurement device measures the humidity near the grid wire. The operation control device operates the movement device when cleaning the grid wire. Further, when the humidity measured by the humidity measurement device exceeds a predetermined threshold, the movement device is not operated.

In this grid wire cleaning mechanism, the grid wire is cleaned by abrading the grid wire with the first abrading member using the movement device. In this way, corona products on the grid wire are removed. The humidity measurement device measures the humidity near the grid wire, and if the measurement result is greater than a threshold value, the movement device is not operated.

Here, when the humidity near the grid wire is higher than the threshold value, the movement device is not operated. Therefore, it is possible to prevent liquid that is formed from corona products dissolved in moisture in the air and that adheres to the surface of the grid wire from being spread by the first abrading member. Further, it is possible to prevent reduction in image quality, and it is possible to prevent the life of the grid wire from being shortened. Also, it is possible to prevent adherence of corona products so it is possible to prevent shortening of the life of the first abrading member.

A grid wire cleaning mechanism according to a second aspect of the present invention is the grid wire cleaning mechanism according to the first aspect, wherein the charging device further has discharge wire disposed parallel to the grid wire that charges the electrostatic latent image carrier. The grid wire cleaning mechanism further includes a second abrading member configured to abrade the discharge wire, and the movement device moves the second abrading member together with the first abrading member.

Here it is possible to clean the discharge wire with the second abrading member at the same time as the grid wire cleaning.

A grid wire cleaning mechanism according to a third aspect of the present invention is the grid wire cleaning mechanism according to the first aspect, wherein it is possible to select alternatively abrading the grid wire with the first abrading member or abrading the discharge wire with the second abrading member.

Here it is possible to clean alternatively the grid wire or the discharge wire.

A grid wire cleaning mechanism according to a fourth aspect of the present invention is the grid wire cleaning mechanism according to the first aspect, wherein the movement device has a shaft member and a tubular shaped member. The shaft member is disposed parallel to the grid wire and provided with a spiral shaped projection continuous with the surface. The tubular shaped member is mounted on the shaft member and configured to rotate relative to the shaft member, on which the first abrading member is provided. The shaft member has a spiral shaped groove on the inside surface that is configured to mesh with the spiral shaped projection.

Here by rotating the shaft member relative to the tubular shaped member, it is possible to move the tubular shaped member. Also, by providing a drive source such as a motor to the shaft member, it is possible to move automatically the tubular shaped member.

A grid wire cleaning mechanism according to a fifth aspect of the present invention is the grid wire cleaning mechanism according to the first aspect, further including a counting device that counts the number of image forming operations of the image forming apparatus, and the operation control device moves the movement device when the number counted by the counting device exceeds a predetermined number.

Here wire cleaning is carried out after every predetermined number of image forming operations. Thus, it is possible to prevent corona products from adhering on the grid wire.

A grid wire cleaning mechanism according to a sixth aspect of the present invention is the grid wire cleaning mechanism according to the first aspect, wherein when operation of the movement device is proscribed by the operation control device, and when the measurement result of the humidity measurement device is less than the predetermined threshold, the operation control unit removes the proscription on the operation of the movement device.

Here, when the humidity is less than a predetermined threshold, moisture on the surface of the grid wire evaporates, the corona products solidify, and the resistance increases. However, after the corona products have solidified on the grid wire, the corona products are removed from the grid wire. Thus, there is no unevenness in cleaning the grid wire, and the electrostatic latent image carrier is uniformly charged.

A grid wire cleaning mechanism according to a seventh aspect of the present invention is the grid wire cleaning mechanism according to the fifth aspect, wherein when operation of the movement device is proscribed by the operation control device, and when the measurement result of the humidity measurement device is less than the predetermined threshold, the operation control unit removes the proscription on the operation of the movement device.

A grid wire cleaning mechanism according to an eighth aspect of the present invention is the grid wire cleaning mechanism according to a first aspect, wherein the humidity measurement device includes a humidity sensor that measures the humidity near the grid wire, and a temperature sensor that measures the temperature near the grid wire, and the absolute humidity near the grid wire is determined from the humidity sensor and the temperature sensor.

Here, the absolute humidity is measured, so the criterion is more objective than if the relative humidity is measured.

A grid wire cleaning mechanism according to a ninth aspect of the present invention is the grid wire cleaning mechanism according to the seventh aspect, wherein the humidity measurement device includes a humidity sensor and a temperature sensor. The humidity sensor measures the humidity near the grid wire. Further, the temperature sensor measures the temperature near the grid wire. Moreover, the absolute humidity near the grid wire is determined from the humidity sensor and the temperature sensor.

A grid wire cleaning mechanism according to a tenth aspect of the present invention is the grid wire cleaning mechanism according to the first aspect, wherein the first abrading member is a grinding member with grinding particles adhering to the surface on the side facing towards the grid wire.

Here, it is easier to remove the corona products adhering to the grid wire.

A grid wire cleaning mechanism according to an eleventh aspect of the present invention is the grid wire cleaning mechanism according to the second aspect, wherein the second abrading member has a non-woven fabric on the part capable of abrading the discharge wire.

A grid wire cleaning mechanism according to a twelfth aspect of the present invention is the grid wire cleaning mechanism according to the fourth aspect, wherein the movement device further includes a motor that rotates the shaft member.

An image forming apparatus according to a thirteenth aspect of the present invention has an electrostatic latent image carrier, a charging device, a developing device, and a grid wire cleaning mechanism according to the first aspect. Electrostatic latent images are formed based on image information on the surface of the electrostatic latent image carrier. The charging device charges the surface of the electrostatic latent image carrier using grid wire. The developing device supplies developer to the electrostatic latent image carrier.

EFFECT OF THE INVENTION

In the present invention, it is possible to prevent a reduction in image quality due to the surface of the electrostatic latent image carrier not being uniformly charged as a result of corona products adhering unevenly to the surface of the grid wires, by preventing the corona products from being spread by the grid wire contact member. In the present invention, it is also possible to prevent shortening of the life of the grid wires and grid wire contact member.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

1. Overall Configuration

Figure 1:
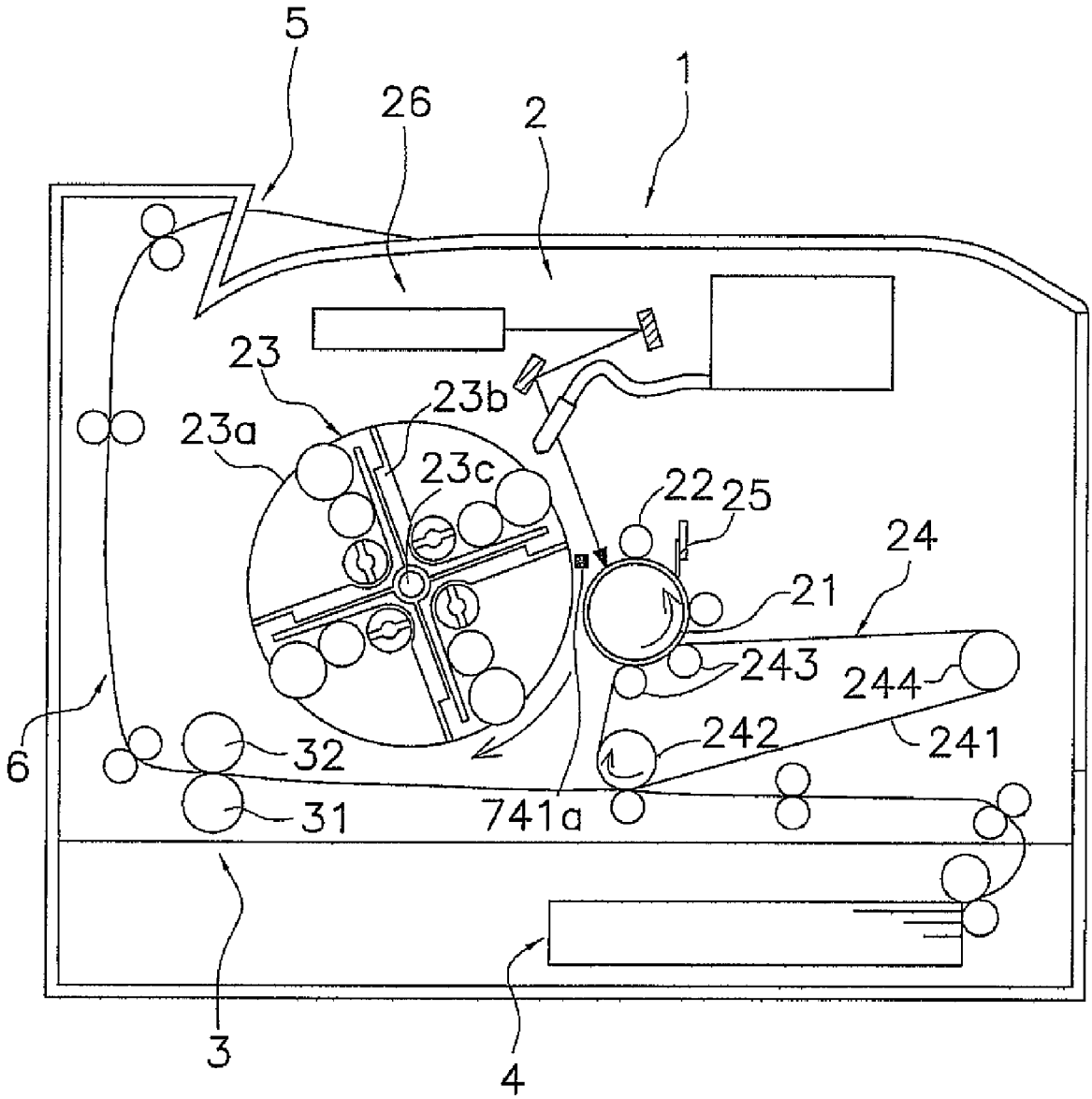
FIG. 1 is an overall cross-sectional schematic diagrammatical view of a color printer according to a first preferred aspect of the present invention.

FIG. 1 is a view of a diagram showing the schematic structure of a color printer 1. As seen in FIGS. 1 to 4, the color printer 1 has a grid wire cleaning mechanism 7 according to an embodiment of the present invention. The grid wire cleaning mechanism 7 cleans the grid wires 224 of a charging device 22.

The color printer 1 includes mainly an image forming unit 2, a fixing unit 3, a sheet storage unit 4, a sheet discharge unit 5, a sheet transport unit 6, and the grid wire cleaning mechanism 7.

As shown in FIG. 1, the image forming unit 2 includes a photosensitive drum 21, the charging device 22, a rotary developing device 23, a transfer device 24, a cleaning device 25, and a laser unit 26. Also, the image forming unit 2 is the part that forms toner images based on image information, and is provided in approximately the center of the color printer 1. The charging device 22 is described in detail below.

The photosensitive drum 21 is the member on whose surface the electrostatic latent image is formed. The photosensitive drum 21 can rotate about an axis of rotation that extends in a direction normal to the plane of the paper in FIG. 1. A humidity and temperature sensor 741*a* (see FIG. 1) is disposed near the position on the photosensitive drum 21 that is exposed to light by the laser unit 26. More preferably, the humidity and temperature sensor 741*a* is located between the charging device 22 and the rotary developing device 23. The humidity and temperature sensor 741*a* is preferably configured to measure the humidity and temperature surrounding the charging device 22, and more preferably to measure the humidity and temperature of the charging device 22.

The rotary developing device 23 is provided adjacent to the photosensitive drum 21, and includes a plurality of developing devices 23*a* and a frame 23*b*. Each of the plurality of developing devices 23*a* contains toner of a different color, and a developing roller to supply toner to the photosensitive drum 21. The frame 23*b* is a member that supports the plurality of developing devices 23*a*, and includes a frame rotational shaft 23*c* disposed parallel to the axis of rotation of the photosensitive drum 21. The frame 23*b* includes four plate shaped members extending from the rotational shaft 23*c* at equal intervals. The developing devices 23*a* are supported between adjacent plate shaped members.

The transfer device 24 transfers toner images on the photosensitive drum 21 onto sheets, and includes a transfer belt 241, a primary transfer roller 242, a pair of secondary transfer rollers 243, and a tension adjustment roller 244. Also, the transfer device 24 is disposed below the photosensitive drum 21. The transfer belt 241 is an endless belt that is wound around the primary transfer roller 242, the pair of secondary transfer rollers 243, and the tension adjustment roller 244. The primary transfer roller 242 transfers toner images onto the sheets. In order that toner images can be transferred from the transfer belt 241 to the sheets transported by the sheet transport unit 6, the primary transfer roller 242 supports the transfer belt 241 so that a part of the transfer belt 241 is disposed on a side of the sheet transfer unit 6. The pair of secondary transfer rollers 243 supports the transfer belt 241 so that a part of the transfer belt 241 is disposed adjacent to the photosensitive drum 21 in order to transfer toner images on the photosensitive drum 21 to the transfer belt 241. The tension adjustment roller 244 is a member that adjusts the tension in the transfer belt 241, and is disposed to the right side in FIG. 1.

The cleaning device 25 is a member that removes residual toner that is not transferred but remains on the photosensitive drum 21. The cleaning device 25 is preferably a plate shaped member that contacts the surface of the photosensitive drum 21.

The laser unit 26 is a device that irradiates the photosensitive drum 21 with laser light based on image data, and is disposed above the rotary developing device 23. The solid line extending from the laser unit 26 in FIG. 1 indicates the path of the laser light.

The fixing unit 3 fixes toner images onto the sheets, and includes a pressure roller 31 and a heating roller 32.

The sheet storage unit 4 stores sheets on which toner images will be fixed, and is disposed in the lower part of the color printer 1.

The sheet discharge unit 5 discharges sheets on which toner images have been fixed, and is disposed in the upper part of the color printer 1.

The sheet transport unit 6 is the part that transports sheets from the sheet storage unit 4 to the sheet discharge unit 5 via the image forming unit 2 and the fixing unit 3. The sheet transport unit 6 preferably includes a plurality of rollers.

2. Charging Device 22

Next the charging device 22 is described.

Figure 2:
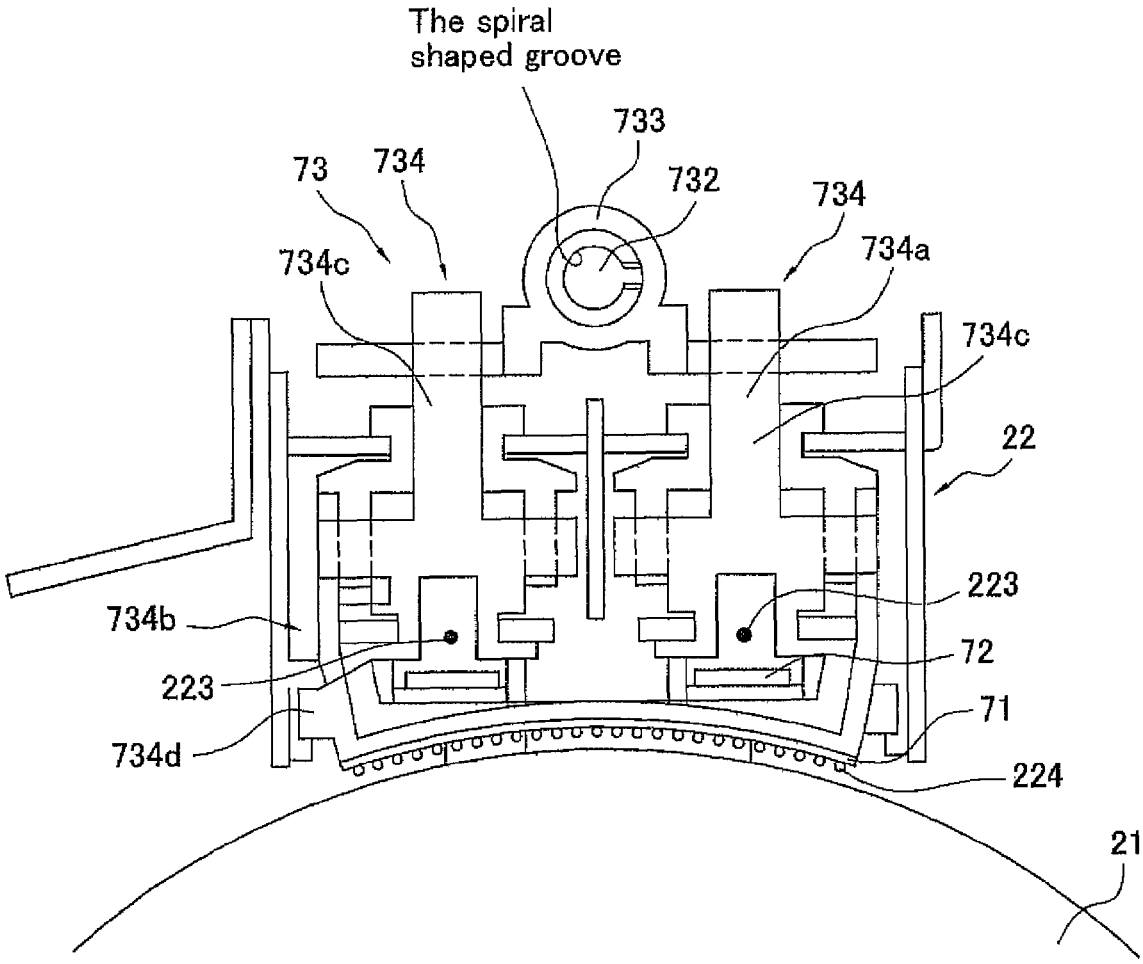
FIG. 2 is a cross-sectional view of a charging device 22 of the color printer.
Figure 3:
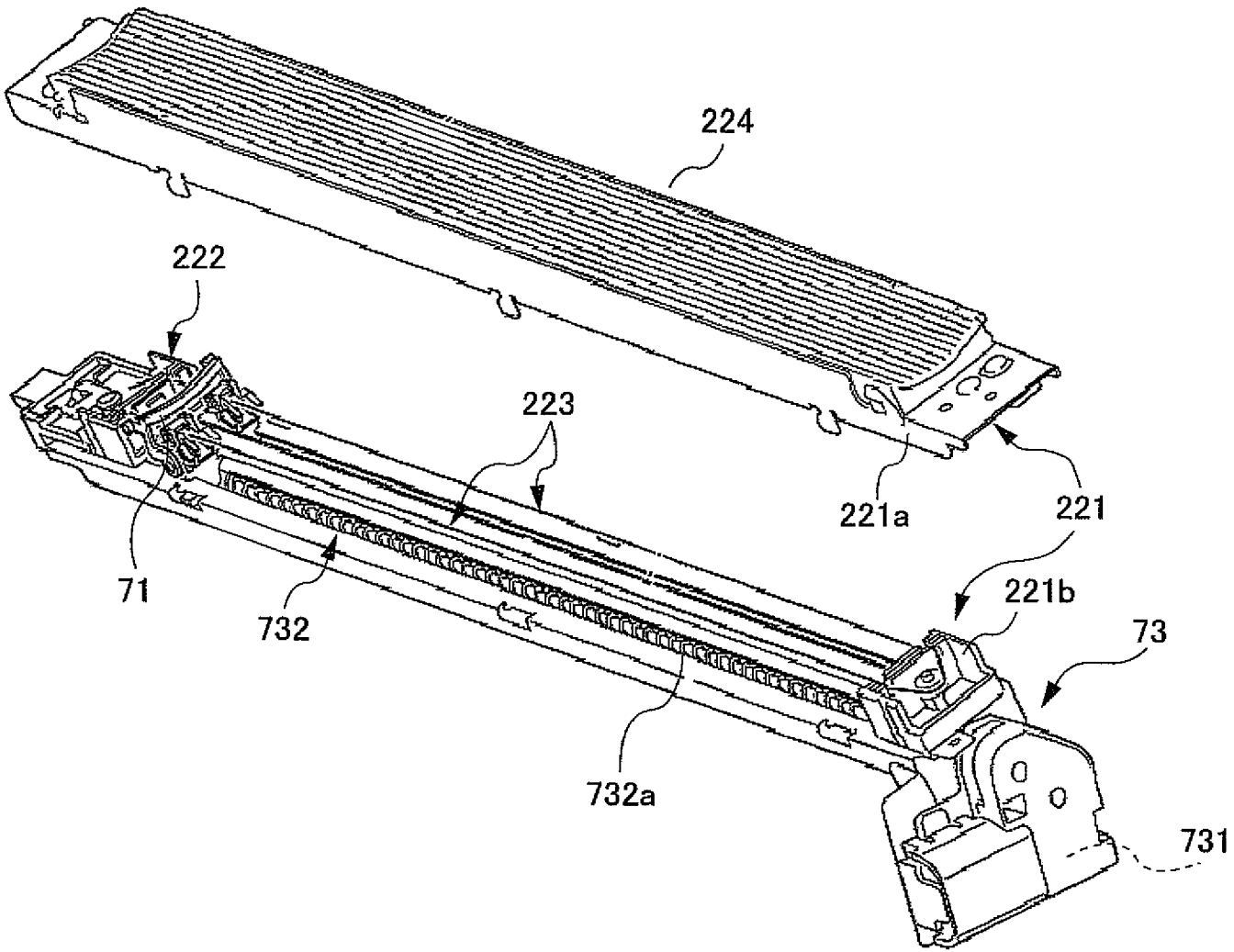
FIG. 3 is a perspective diagrammatical view showing the charging device and a movement device of the color printer.
Figure 4:
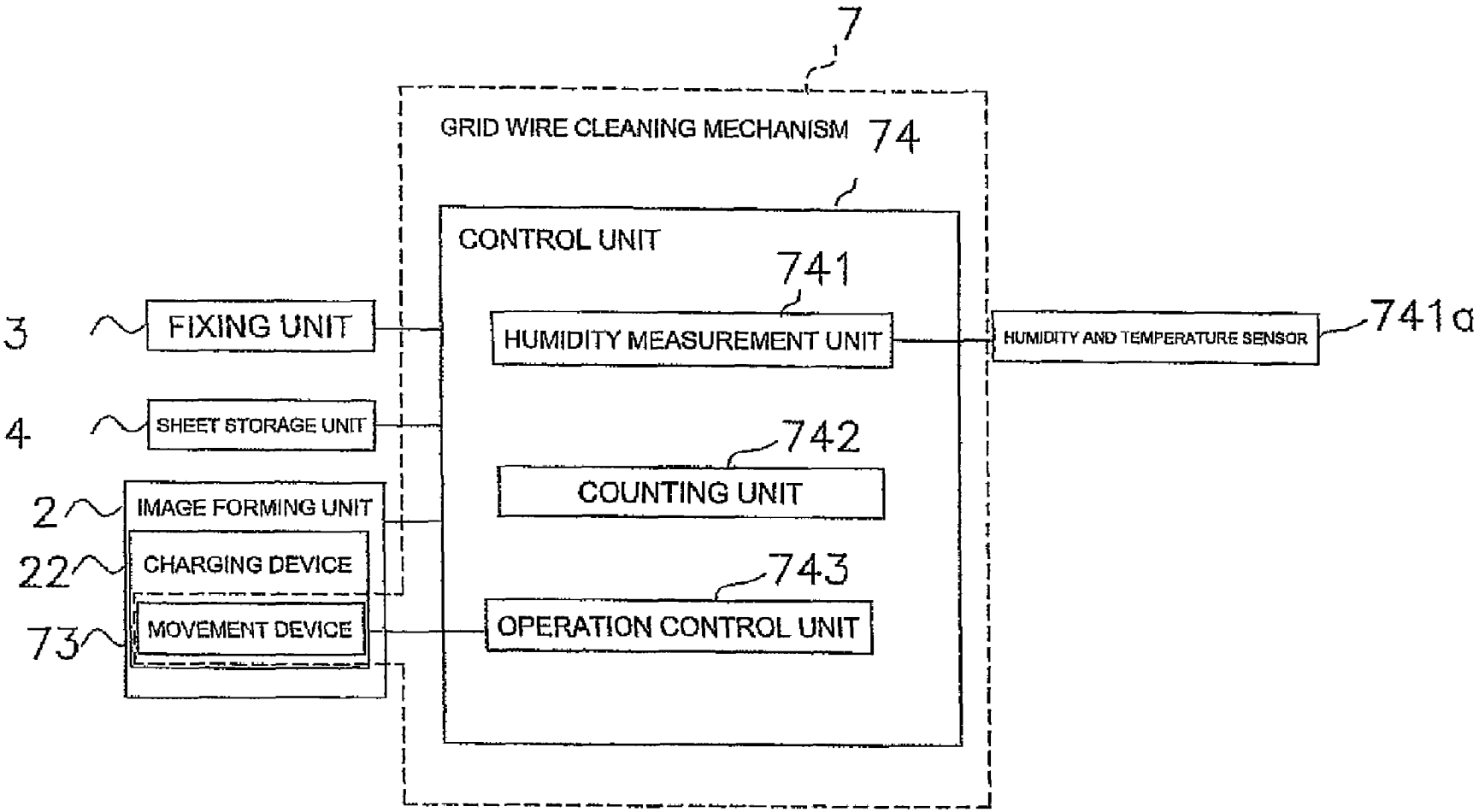
FIG. 4 is a view of a block diagram of a control unit and other parts of the color printer.

The charging device 22 charges the surface of the photosensitive drum 21. As shown in FIGS. 2, 3, and 4, the charging device 22 includes a device case 221, a power supply 222, a pair of discharge wires 223, a plurality of grid wires 224, and the grid wire cleaning mechanism 7. Also, the charging device 22 is disposed above the photosensitive drum 21. The following is a detailed description of the grid wire cleaning mechanism 7.

The device case 221 is a member that supports the grid wires 224 and the discharge wires 223, and includes a grid support housing 221*a* and a discharge wire support housing 221*b*. The grid support housing 221*a* is a member that supports the grid wires 224, and is a plate shaped member extending in the direction that the grid wires 224 extends, i.e., the stretching direction. The discharge wire support housing 221*b* is a member that supports the discharge wires 223, and is provided in opposition to the grid support housing 221*a*.

The power supply 222 is a device that supplies electrical power to the discharge wires 223 and the grid wires 224. The power supply 222 applies a high voltage current to the discharge wires 223, and a bias voltage to the grid wires 224. Then, to charge the photosensitive drum 21, the discharge wires 223 are made to discharge. The surface of the photosensitive drum 21 is uniformly charged, and excess discharge current flows to the grid wires 224.

The discharge wires 223 charge the surface of the photosensitive drum 21. Further, each discharge wire 223 is supported at both ends by the discharge wire support housing 221*b*. Discharge occurs when a high voltage is applied by the power supply 222. Also, the surface of the two discharge wires 223 is plated, and the two discharge wires 223 are disposed at a predetermined distance apart.

The grid wires 224 uniformly charge the surface of the photosensitive drum 21, and are disposed at a predetermined distance from the surface of the photosensitive drum 21. Also, the grid wires 224 are supported by the grid wire support housing 221*a*, and is disposed between the discharge wires 223 and the photosensitive drum 21.

3. Grid Wire Cleaning Mechanism 7

The grid wire cleaning mechanism 7 is provided to clean the grid wires 224, and includes a first abrading member 71, a second abrading member 72, a movement device 73, and a control unit 74 (see FIG. 4).

Referring to FIGS. 2 to 4, the first abrading member 71 is disposed to be able to abrade the grid wires 224, and includes a grinding member with grinding powder adhering to the surface on the side facing towards the grid wires 224.

The second abrading member 72 is a member disposed to be able to abrade the discharge wires 223, and includes a non-woven fabric in the portion that can abrade the discharge wires 223.

The movement device 73 is provided to move the first abrading member 71 and the second abrading member 72, and includes a motor 731, a movement rotation shaft 732, a tubular shaped member 733 (tubular shaped unit), and a pair of support members 734. The motor 731 is disposed at one end of the movement rotation shaft 732, and rotates the movement rotation shaft 732. The movement rotation shaft 732 is preferably disposed parallel to the grid wires 224, and is a shaft preferably provided with a spiral shaped protrusion 732*a*. The tubular shaped member 733 is mounted on the movement rotation shaft 732 so that the tubular shaped member 733 can move relative to the movement (rotation) of the rotation shaft 732. A spiral shaped groove (not shown on the drawings) that can mesh with the spiral shaped protrusion 732*a* is formed on the inside of the tubular shaped member 733. Also, the tubular shaped member 733 is preferably provided with two pairs of projections that project in directions at right angles to the direction of extension of the movement rotation shaft 732. The two support members 734 are provided to support the first abrading member 71 and the second abrading member 72. The two support members 734 are slidably supported in the direction of extension of the movement rotation shaft 732 by the discharge wire support housing 221*a*. The two support members 734 include a first support member 734*a* that supports the first abrading member 71, and a second support member 734*b* that supports the second abrading member 72. The first support member 734*a* has two intermediate members 734*c* that extend in one direction. The intermediate members 734*c* become gradually thinner at the end towards the tubular shaped member 733. The ends are disposed between the two pairs of projections provided on the tubular shaped member 733. Also, the two intermediate members 734*c* are disposed corresponding respectively to the two discharge wires 223, and the first abrading member 71 is disposed on the other end. The second support member 734*b* supports the second abrading member 72, and has a second abrading member support member 734*d* that is supported by the intermediate member 734*c* of the first support member 734*a*. The second abrading member support member 734*d* is a member with an approximately U-shaped cross-section, disposed so as to sandwich the two intermediate members 734*c*. Also, the second abrading member 72 is disposed on the grid wires 224 side (the side on which the photosensitive drum 21 is disposed) of the second abrading member support member 734*d*. By changing the angle of the support member 734, it is possible to select alternatively the first abrading member 71 to abrade the grid wires 224, or the second abrading member 72 to abrade the discharge wires 223.

The control unit 74 controls the movement device 73, and includes a CPU, memory, and so on. The control unit 74 preferably functions as a humidity measurement unit 741, a counting unit 742, and an operation control unit 743 by executing programs in the CPU. The control unit 74 carries out control of all parts (the image forming unit, and so on).

The humidity measurement unit 741 measures the humidity and temperature near the grid wires 224 from the humidity and temperature sensor 741*a*, and from the measured temperature and humidity determines the absolute humidity, preferably of the area around the charging device 22, and more preferably of the charging device 22.

The counting unit 742 counts the number of image forming operations.

When the number of image forming operations counted by the counting unit 742 is equal to or greater than a predetermined number, the operation control unit 743 controls the movement device 73 to move the first abrading member 71 and the second abrading member 72 to clean the grid wires 224 and the discharge wires 223. Here, if the absolute humidity determined by the humidity measurement unit 741 is equal to or greater than a predetermined threshold, specifically 20.0 $g/m^3$, the movement device 73 is not operated. In other words, the first abrading member 71 and the second abrading member 72 are not moved. Then, in this case when the absolute humidity drops below 20.0 $g/m^3$ after some time has passed, the movement device 73 is moved, in other words the first abrading member 71 and the second abrading member 72 are moved, and the grid wires 224 and the discharge wires 223 are cleaned.

4. Operation

The following is an explanation of the operation of the color printer 1.

Referring to FIGS. 1 to 3, when image information is sent to the color printer 1 from an externally connected computer or the like, the surface of the photosensitive drum 21 is charged by the charging device 22. Specifically, high voltage current is applied to the discharge wires 223, and bias voltage is applied to the grid wires 224. When the discharge wires 223 discharge, the surface of the photosensitive drum 21 is charged, the surface of the photosensitive drum 21 is uniformly charged by the grid wires 224, and excess discharge current flows to the grid wires 224. The charged surface of the photosensitive drum 21 is irradiated with laser light from the laser unit 26, based on image information. When the electrostatic latent image is formed on the photosensitive drum 21 in this way, toner of the respective colors is supplied to the photosensitive drum 21 by the rotary developing device 23. In this way, a toner image is formed on the photosensitive drum 21. This toner image is transferred by the transfer device 24 to a sheet transported by the sheet transport unit 6 from the sheet storage unit 4. The sheet onto which the toner image has been transferred is transported to the fixing unit 3, and after the toner image is fixed in the fixing unit 3, the sheet is discharged from the sheet discharge unit 5.

Figure 5:
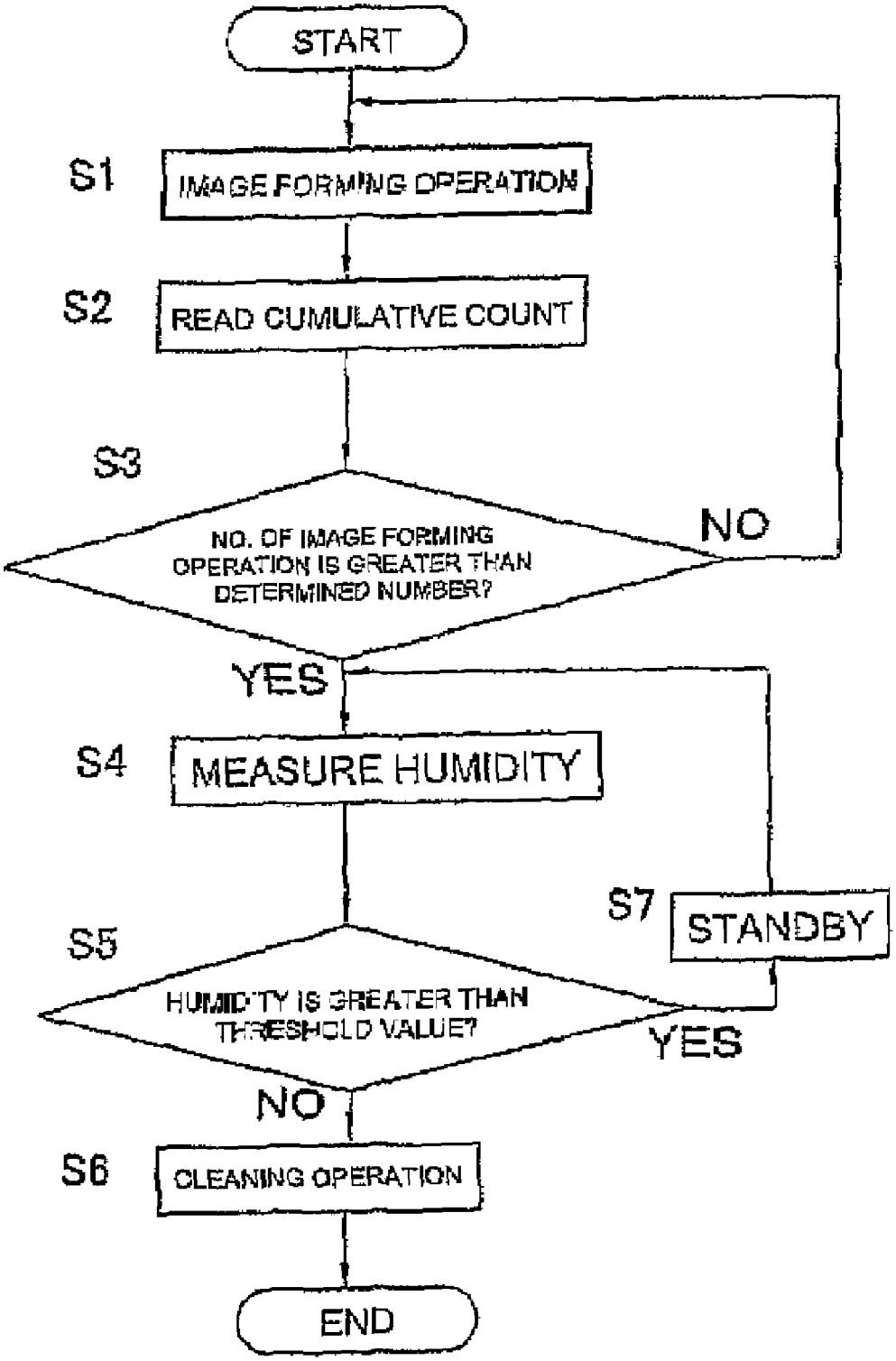
FIG. 5 is a view of a flowchart of a cleaning operation of the color printer.

Next, the operation of cleaning the grid wires 224 and the discharge wires 223 is explained with reference to the flowchart in FIG. 5.

When an image forming operation is carried out (S1), [1] is added to the image forming operation cumulative count. After the image forming operation, the cumulative count is read (S2). After the cumulative count is read, it is determined whether the cumulative count is equal to or greater than a predetermined number (S3). If the cumulative count is less than the predetermined number (S3: NO), the next image forming operation is carried out. If the cumulative count is equal to or greater than the predetermined number (S3: YES), the absolute humidity is measured by the humidity measurement unit 741 (S4). It is determined whether the absolute humidity is equal to or greater than the threshold value (S5). If the humidity is equal to or greater than the threshold value (S5: YES), the process goes on standby until the humidity is less than the threshold value (S7). If the humidity is less than the threshold value (S5: NO), or if the humidity falls below the threshold value during the standby state, the grid wires 224 and the discharge wires 223 are cleaned. In other words, the movement device 73 is operated, and the first abrading member 71 and the second abrading member 72 are moved. Specifically, on the outward path, the second abrading member 72 is moved while the second abrading member 72 is in contact with the discharge wires 223, and on the return path the first abrading member 71 is moved while the first abrading member 71 is in contact with the grid wires 224.

Here, if the humidity near the grid wires 224 is high, the grid wires 224 are not cleaned (standby). Therefore, spreading of liquefied corona products near the grid wires 224 is prevented. Further, discharge current uniformly flows from the discharge wires 223 to the grid wires 224, so reduction in image quality caused by charging defects can be prevented. Also, both the first abrading member 71 and the second abrading member 72 are provided, so it is possible to clean both the discharge wires 223 and the grid wires 224. Furthermore, the discharge wires 223 and grid wires 224 cleaning operation is carried out every predetermined number of image forming operations. Therefore it is possible to prevent more than a predetermined quantity of corona products from remaining. Further, it becomes difficult for corona products to hinder the flow of discharge current in the grid wires 224.

5. Other Embodiments (a) In the above embodiment, the color printer 1 was explained as an image forming apparatus. However, the present invention is not limited to this, and a photocopier, multi-function printer, or the like may also be used.

(b) Also, in the above embodiment, it was determined whether to operate the movement device 73 based on the absolute humidity. However, the present invention is not limited to this, and the determination may also be made based on the relative humidity.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers, and/or steps. The foregoing also applies to words having similar meanings such as the terms, "including," "having," and their derivatives. Also, the terms "part," "section," "portion," "member," or "element" when used in the singular can have the dual meaning of a single part or a plurality of parts. As used herein to describe the present invention, the following directional terms "forward, rearward, above, downward, vertical, horizontal, below, and transverse" as well as any other similar directional terms refer to those directions of an image forming apparatus equipped with the present invention. Accordingly, these terms, as utilized to describe the present invention should be interpreted relative to an image forming apparatus equipped with the present invention as normally used. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A grid wire cleaning mechanism being configured to clean grid wire of a charging device being configured to charge the surface of an electrostatic latent image carrier of an image forming apparatus, comprising:

a first abrading member being configured to abrade the grid wire;

a movement device being configured to move the first abrading member along a stretching direction of the grid wire;

a humidity measurement device being configured to measure humidity of the charging device; and an operation control device being configured to operate the movement device when cleaning the grid wire, and not to operate the movement device when the humidity measured by the humidity measurement device exceeds a predetermined threshold.

2. The grid wire cleaning mechanism according to claim 1, further comprising a second abrading member, wherein the charging device further has discharge wire disposed parallel to the grid wire that charges the electrostatic latent image carrier, the second abrading member is configured to abrade the discharge wire, and the movement device moves the second abrading member together with the first abrading member.

3. The grid wire cleaning mechanism according to claim 2, wherein the operation control device is configured to make a selection between abrading the grid wire with the first abrading member or abrading the discharge wire with the second abrading member.

4. The grid wire cleaning mechanism according to claim 1, wherein the movement device includes a shaft member disposed parallel to the grid wire and provided with a spiral shaped projection continuous with the surface, and a tubular shaped member mounted on the shaft member and configured to rotate relative to the shaft member, on which the first abrading member is provided, and that has a spiral shaped groove on the inside surface that is configured to mesh with the spiral shaped projection.

5. The grid wire cleaning mechanism according to claim 1, further comprising a counting unit that counts the number of image forming operations of the image forming apparatus, and the operation control device moves the movement device when the number counted by the counting unit exceeds a predetermined number.

6. The grid wire cleaning mechanism according to claim 1, wherein when operation of the movement device is proscribed by the operation control device, and when the measurement result of the humidity measurement device is less than the predetermined threshold, the operation control unit removes the proscription on the operation of the movement device.

7. The grid wire cleaning mechanism according to claim 5, wherein when operation of the movement device is proscribed by the operation control device, and when the measurement result of the humidity measurement device is less than the predetermined threshold, the operation control unit removes the proscription on the operation of the movement device.

8. The grid wire cleaning mechanism according to claim 1, wherein the humidity measurement device includes a humidity sensor that measures the humidity of the charging device, and a temperature sensor that measures the temperature of the charging device, and the absolute humidity of the charging device is determined from the humidity sensor and the temperature sensor.

9. The grid wire cleaning mechanism according to claim 7, wherein the humidity measurement device includes a humidity sensor that measures the humidity of the charging device, and a temperature sensor that measures the temperature of the charging device, and the absolute humidity of the charging device is determined from the humidity sensor and the temperature sensor.

10. The grid wire cleaning mechanism according to claim 1, wherein the first abrading member is a grinding member with grinding particles adhering to the surface on the side facing towards the grid wire.

11. The grid wire cleaning mechanism according to claim 2, wherein the second abrading member has a non-woven fabric on the part configured to abrade the discharge wire.

12. The grid wire cleaning mechanism according to claim 4, wherein the movement device further has a motor that rotates the shaft member.

13. An image forming apparatus, comprising:

an electrostatic latent image carrier, electrostatic latent images being formed based on image information on the surface thereof;

a charging device being configured to charge the surface of the electrostatic latent image carrier using grid wire;

a developing device being configured to supply developer to the electrostatic latent image carrier; and a grid wire cleaning mechanism having a first abrading member being configured to abrade the grid wire, a movement device being configured to move the first abrading member along a stretching direction of the grid wire, a humidity measurement device being configured to measure humidity of the charging device, and an operation control device being configured to operate the movement device when cleaning the grid wire, and not to operate the movement device when the humidity measured by the humidity measurement device exceeds a predetermined threshold.

* * * * *